US005292147A

United States Patent [19]

Bejean

[11] Patent Number: 5,292,147

[45] Date of Patent: Mar. 8, 1994

[54] CROSS COUNTRY SKI, ESPECIALLY FOR THE PRACTICE OF ALTERNATING STEPS

[75] Inventor: Alain Bejean, Alby sur Cheran, France

[73] Assignee: Salomon S.A., Annecy Cedex, France

[21] Appl. No.: 747,952

[22] Filed: Aug. 21, 1991

[30] Foreign Application Priority Data

Aug. 24, 1990 [FR] France ..... 90 10747

[51] Int. Cl.[5] ..... A63C 5/07

[52] U.S. Cl. ..... 280/602; 280/610

[58] Field of Search ..... 280/604, 610, 602, 601, 280/609

[56] References Cited

U.S. PATENT DOCUMENTS 4,165,886 8/1979 Nussbaumer ..... 280/610 X
4,804,200 2/1989 Kuchler ..... 280/615

FOREIGN PATENT DOCUMENTS 696576 9/1940 Fed. Rep. of Germany ..... 280/610
3619118 12/1987 Fed. Rep. of Germany .
3929625 4/1990 Fed. Rep. of Germany .
WO 86/04824 8/1986 World Int. Prop. O. .

OTHER PUBLICATIONS

French Search Report and Annex.

*Primary Examiner*—Margaret A. Focarino
*Assistant Examiner*—Michael Mar
*Attorney, Agent, or Firm*—Sandler Greenblum & Bernstein

[57] ABSTRACT

A cross country ski in which, in the central portion of the ski, in the gripping zone of the boot, the heel zone acts as a support of the foot during a sliding phase, and a metatarso-phalangian support zone of the impulsion in the impulsion phase of the ski, a transverse slit is arranged, crossing the ski. The slit defines two flexion beams, upper and lower, respectively, in the thickness of the ski. This arrangement enables, during the impulsion phase, a good flattening on the ground of the lower beam and thus of the sole portion of the ski, i.e., the waxing chamber. The efficiency of the impulsion is thus substantially increased without affecting the sliding phase.

31 Claims, 7 Drawing Sheets

S
2
PI
Pi
6
T
4
1
3
TS
5
7
8

CROSS COUNTRY SKI, ESPECIALLY FOR THE PRACTICE OF ALTERNATING STEPS

BACKGROUND OF THE INVENTION

1. Field of the Invention

The present invention is related to cross-country skis and, especially, to those that are used for practicing the traditional step, called alternating step, as opposed to the sliding step.

2. Description of Background and Relevant Information

A cross country ski generally comprises an arched central portion when at rest, with an upward convexity, demarcated by two lines of contact with the ground, front and rear, respectively, separating this central portion respectively from the spatula and the heel of the ski. The support zone of the foot of the skier is located at a medium position with respect to this central part, at least approximately.

While practicing the alternating step, this support of the foot manifests itself between the sole of the ski and the ground, mainly at two very restricted, and localized points or zones.

During impulsion for forward advance, the foot of the skier takes support at the level of the metatarsal-phalanges joint, from which the position of the support point on the ski or the support point of the impulsion is defined. It is at the level of this point that maximum pressure is exercised in order to flatten the ski by elasticity against the slight bend of the central portion. In the sliding phase or advance of the ski, it is by the heel that the foot provides support on the ski. Due to the original camber of the ski, and the relative position of the foot with respect to it, this support of the heel leaves a residual arched zone in front of its application point, which thus corresponds to zero pressure of the ski on the ground, and which is commonly called "waxing chamber". Indeed, it is in this zone that it is wisest to apply to the sole of the ski, a retention wax or any other means resisting backward movement, such as scales, seal skin, anti-backward movement chemical coating, etc . . . . This retention wax, or any other means, is only effective when in contact with the ground, that is, during the impulsion phase, stopping the ski from sliding back by the positive reaction that the ground can then exercise on the ski.

This distribution along the sole of the ski is of considerable importance because it conditions the efficiency of the impulsion transmitted by the metatarsal-phalange support in the impulsion or impulse phase and the quality of the sliding during support of the heel.

For a traditional ski, basically adapted to alternating steps, one notes, as is illustrated in FIG. 1, that this pressure distribution along the ski is not ideal. This diagram represents sequenced contact pressure, in accordance with the position on the ski in abssicus, between spatula S and the heel of the ski Ts, respectively in the impulsion phase, in dotted and dashed lines, and in the sliding phase, in non-broken lines. The support points in impulsion and of the heel are respectively referenced by Pi and T. One notes that if, in the sliding or heel support phase, the waxing chamber 8 or the zero pressure zone does in fact exist, during the impulsion phase (dotted and dashed lines), the pressure, which is maximum at the level of impulsion point Pi, is exercised on either side of this point such that it is very diffused and wide on the one hand, and has relatively little intensity in the zone of the waxing chamber 8 on the other hand, substantially hindering the efficiency of impulsion in this way.

SUMMARY OF THE INVENTION

An object of the present invention is to overcome this disadvantage, or at least, significantly reduce this disadvantage, by concentrating the impulsion pressure on the zone of the waxing chamber 8.

BRIEF DESCRIPTION OF THE DRAWINGS

The characteristics and advantages of the invention will become apparent from the description and the various embodiments that follow, and will be further explained with reference to the annexed drawings, in which.

DETAILED DESCRIPTION OF THE PREFERRED EMBODIMENTS

Figure 1:
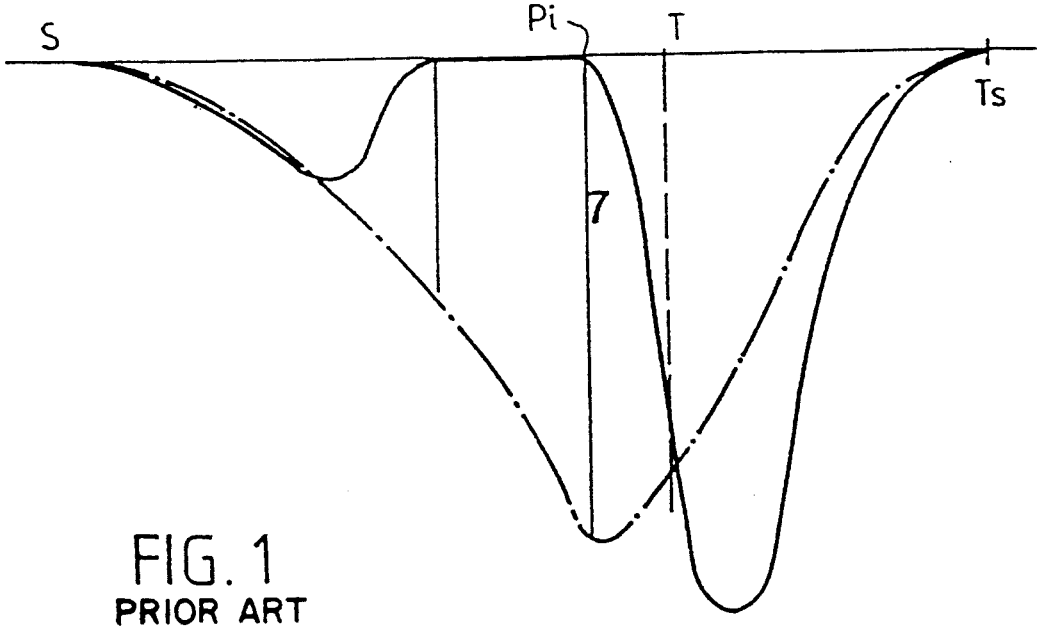
FIG. 1 PRIOR ART
FIG. 1, mentioned above, is a diagram explicitly representing the known state of the art.

An object of the invention is to eliminate, or at least to considerably reduce the disadvantages mentioned above, by arranging in the thickness of the ski, in the central portion corresponding at least approximately to the area of support of the foot of the skier, an open portion, or transverse slit crossing the ski to define two upper and lower beams, respectively. During an immpulsion force, the upper beam, by flexing, comes into contact with the lower beam which flexes in turn so as to generate contact pressure with the ground which enables impulsion.

In the drawings, a cross-country ski is represented by a heel $T_s$, its spatula S, and its front 2 and rear 3 contact lines with the ground respectively, demarcating the central portion 1 between them. A boot 4 is represented schematically, and the force application points of the heel support T and of the impulsion or metatarsal-phalange support Pi are highlighted. In the thickness of the central portion 1 and in the more restricted zone corresponding especially, to that covering the assembly of boot 4, an open space is arranged, for example in the shape of a slit 5 of small thickness. This slit 5 defines a sharing zone by separating the ski between the two upper 6 and lower 7 beams, respectively. This longitudinal slit, transversely extending, is located at the rear of the so-called point of equilibrium Pl of the ski, corresponding to the localization of the front end of the boot 4. Moreover, it extends towards the rear to a point located in the vicinity of point T where, in the sliding phase, the force of the heel support of boot 4 is exercised. Preferably, slit 5 is located in the thickness of its ski at the level of the neutral fiber.

Figures 2, 3, 4, 5:
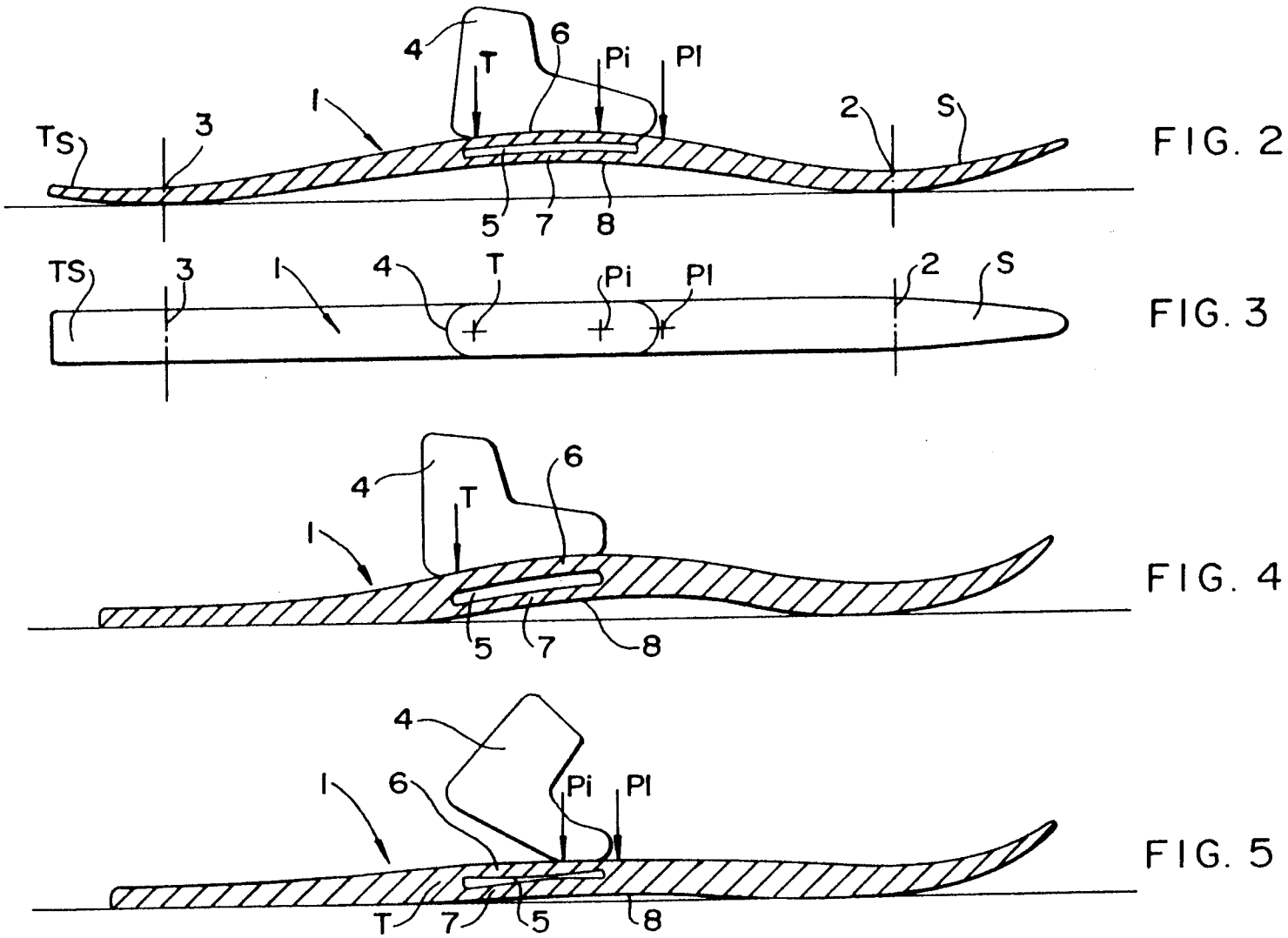
FIG. 2 is a longitudinal sectional view of a ski at rest wherein the present invention is implemented.
FIG. 3 is a top plan view of the same ski.
FIG. 4 is a longitudinal sectional view of the same ski, but during the sliding phase.
FIG. 5 is also a longitudinal sectional view of the same ski, but during the impulsion phase.

As can be seen better in FIGS. 4 and 5, the slit 5 fulfills two distinct functions. In the sliding phase (FIG. 4), during support of heel T, it opens the waxing chamber 8 upwardly, this element having been introduced hereinabove in the introduction, by a scissoring phenomenon introduced between the upper beam 6 and the lower beam 7. On the other hand, in the impulse phase (FIG. 5), it enables the waxing chamber 8 to be optimally flattened, that is, with maximum intensity, of the waxing chamber 8 on the ground, by support during impulsion Pi of the upper beam 6 on lower beam 7.

Figure 6:
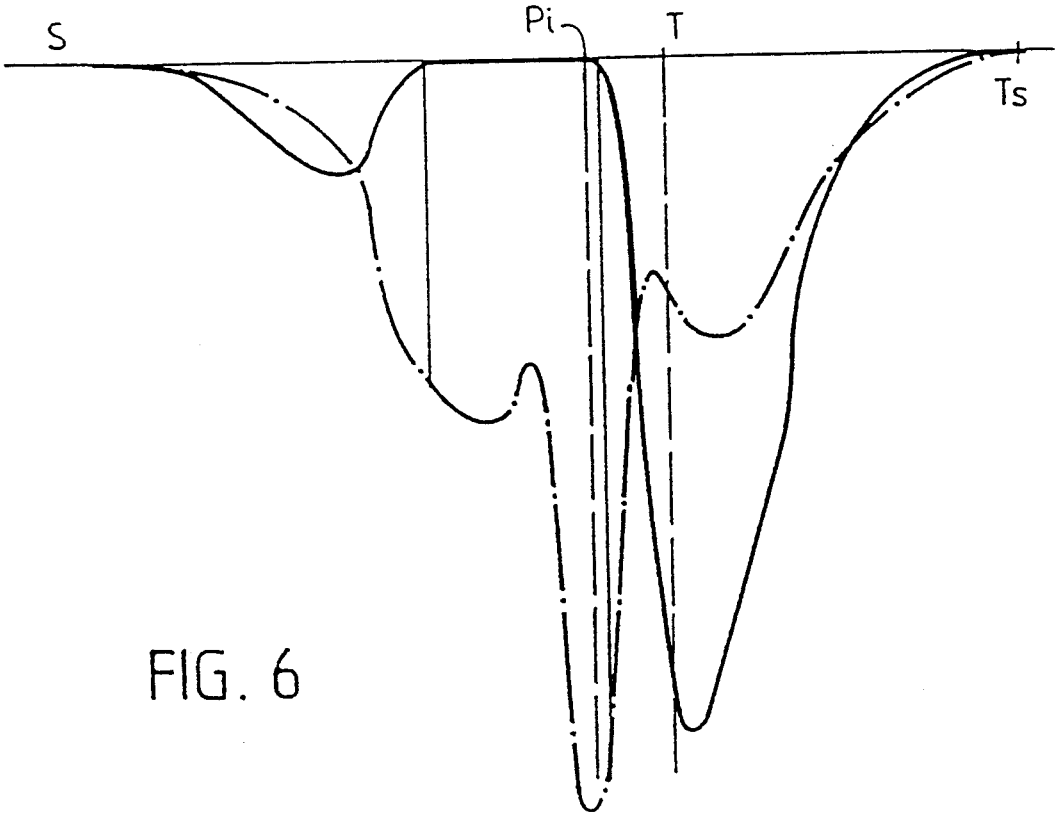
FIGS. 6 and 7 are two embodiments similar to FIG. 1, showing the distribution of contact pressure in accordance with two embodiments of the invention.

Advantageously, the impulsion point Pi located in the area of slit 5 will be localized in front of the center of this slit area, and preferably two-thirds toward the front of it. Indeed, if the impulsion point Pi is centered longitudinally with respect to slit 5, optimal distribution of contact pressures between the sole of the ski and the ground during impulsion efforts is not achieved. This is illustrated in the diagram of FIG. 6, which is similar to the diagram represented in FIG. 1, where it can be seen on either side of the impulsion point zone Pi, where there is a peak of intensity, i.e. two ranges of pressure whose intensity still remains substantial. The pressures exercised correspond to a load equivalent to the normal weight of a skier, that is, approximately 60–85 kgs.

Figure 7:
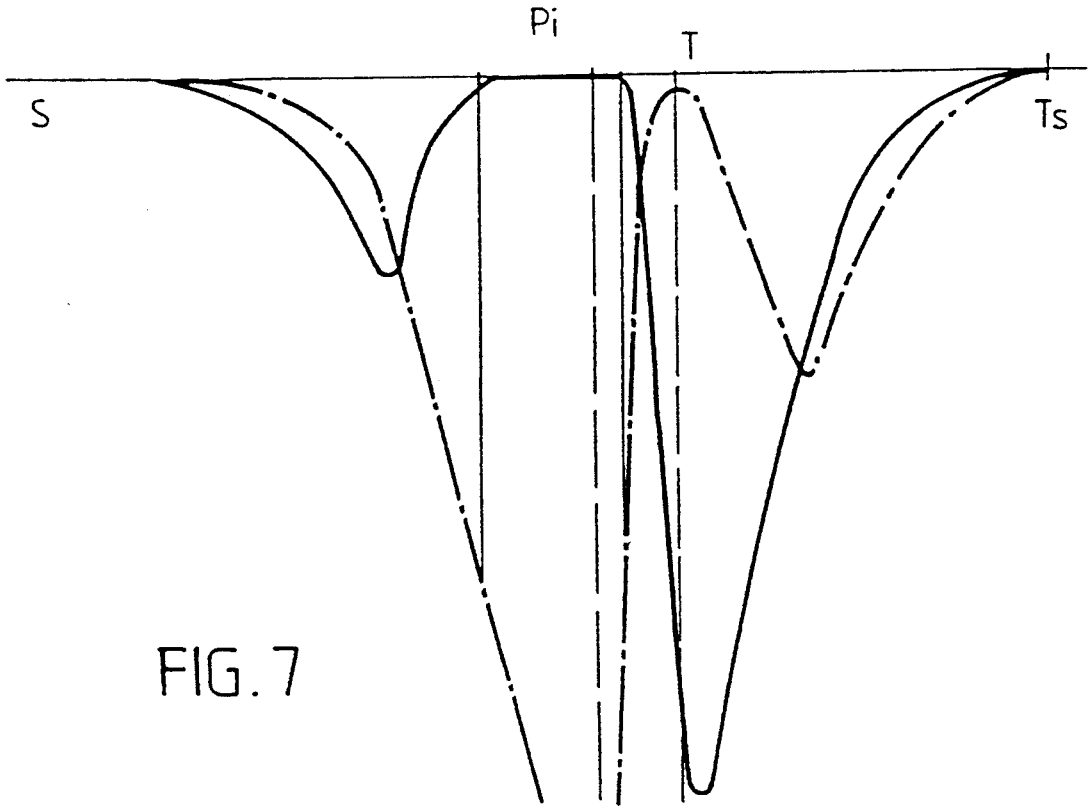

The diagram of FIG. 7 represents the distribution of contact pressure when the impulsion point Pi is located, as has been mentioned above, at two-thirds of slit 5 in the direction of the spatula S of the ski.

The length of slit 5 can of course vary, and is a function of the length of the ski and the size of boot 4 of the wearer. It is clear that the longer the slit 5, the greater the tendency of the waxing chamber 8 to be curved, and thus, the contact pressure will increase in this zone during exertion of impulsion force Pi. For an average ski, the length of slit 5 may vary, for example, between 150 and 300 mm according to the rigidity in flexion of the upper beam 6. In a preferred range of 210 to 250 mm, only the impulsion pressure Pi varies and increases significantly, the pressure in the waxing chamber zone 8, remaining approximately constant.

For a very demanding skier, one can adjust the length of slit 5 in accordance with the size of boot 4 and the weight of the skier. This may be done by placing in slit 5 a wedge that is in contact with upper and lower beams 6 and 7, this wedge being able to be equipped with a cursor, displaceable longitudinally in slit 5, and possibly latchable in the adjusted position. Also, one can provide an adjustment of the thickness of the slit by means of longitudinal wedges of more or less substantial thickness.

Moreover, it must be noted that the thickness of slit 5, if it is to be adequate, must remain relatively small, or else the ski may become too fragile. A thickness of about 2–4 mm gives excellent results.

If slit 5 remains laterally opened towards the outside, involuntary entries of snow, mud, gravel or other undesirable foreign bodies may enter. As such, it can be provided that slit 5 be filled with an elastic material, very easily deformable in compression, such as for example, a plastic foam. The slit 5 may also be laterally blocked by a tongue or any other equivalent means.

Figure 8:
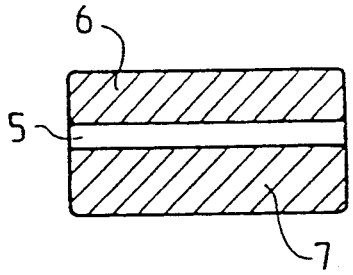
FIGS. 8 and 9 illustrate in a partial transverse section of a traditional ski and of a so-called trapezoidal ski respectively, two embodiments of the invention.
Figure 9:
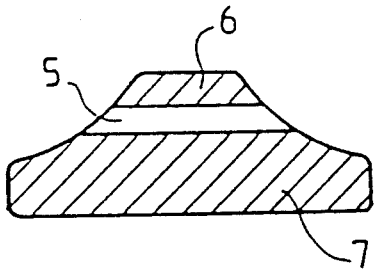

The slit 5 that has just been described may also be used in any other type of skis, such as traditional skis as illustrated in a transverse section in FIG. 8, or trapezoidal section skis, curvilineal or not, as is shown in FIG. 9, or even in completely asymmetrical sections (not represented).

Figure 10:
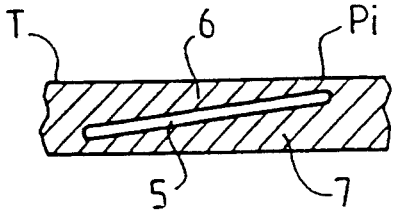
FIGS. 10 and 11 represent a partial longitudinal section of a detail of two embodiments of the invention.

The slit 5, in the variants that have just been mentioned, may also be arranged obliquely, rectilinear or not, in the thickness of the ski, as is represented in FIG. 10 in a partial longitudinal section, beginning at the heel zone T towards the point of impulsion Pi. This device induces a gradation in the resistance to flexion of the upper beam 6, this flexion being greater in the zone of the impulsion point Pi, by favoring the flattening of waxing chamber 8, but this tends, however, to make upper beam 6 more fragile in this zone.

Figure 11:
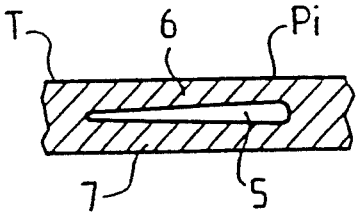

Also, as is illustrated in FIG. 11, the slit 5 may be provided with variable thickness, and can cross heel T towards the impulsion point Pi. This arrangement has approximately the same advantages as those that have been described immediately above.

For the provision of slit 5 in the thickness of the ski, several methods can be envisioned.

One can use traditional machining by lifting material from the finished ski. This solution, however, has a disadvantage that the core of the ski, generally made of rigid plastic foam (such as polyurethane), does not have adequate intrinsic resistance to adequately withstand scissoring forces.

Figure 12:
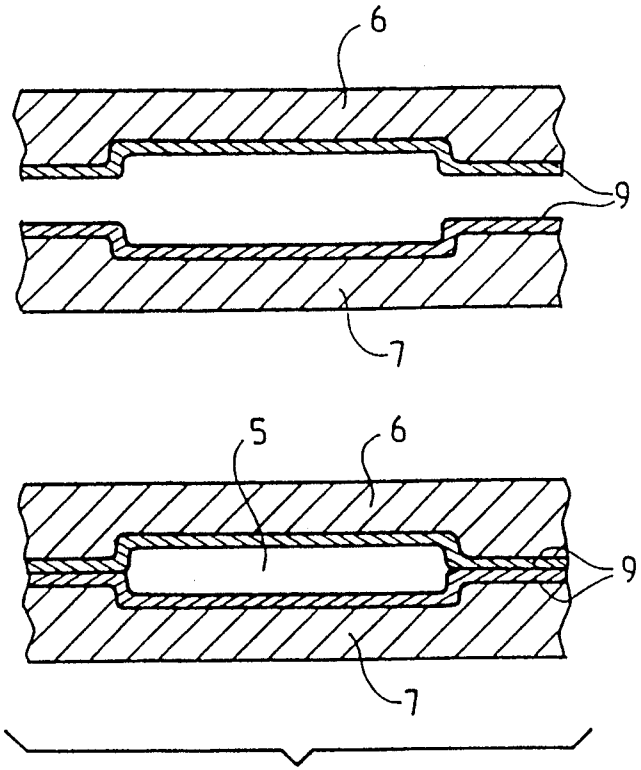

Another solution that does not have this disadvantage comprises independently duplicate molding each of the two upper and lower beams 6 and 7 on a thickness of reinforcement 9, constituted for example of fiber and shaped in a mold to define the upper and lower walls of the slit 5. The beams 6, 7 are then assembled by adhesion, as is illustrated in FIG. 12. In this case, it is possible to make a single beam (shaped in a mold), preferably the upper 6, the second 7 being planar on the side of its adhesion surface.

Figure 13:
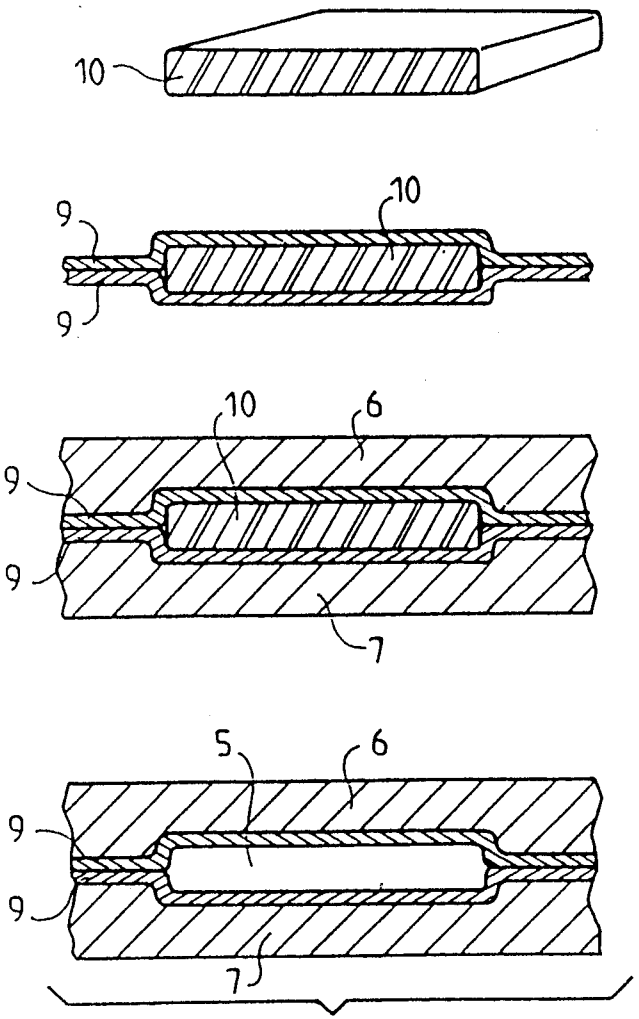
FIGS. 12 and 13 illustrate in a partial longitudinal section two manufacturing methods of a ski respectively according to the invention.

It is also possible to first proceed with the coating of a full molding core 10, defining the future slit 5, by two reinforcements 9 similar to those mentioned previously, and to thereafter proceed with a duplicate molding of the remainder of the ski especially beams 6 and 7, around a core 10 coated by reinforcements 9. The molding core 10 is then removed, thus definitively releasing slit 5. These different consecutive operations, traditional for a person of ordinary skill in the art, are illustrated in FIG. 13.

Figure 14:
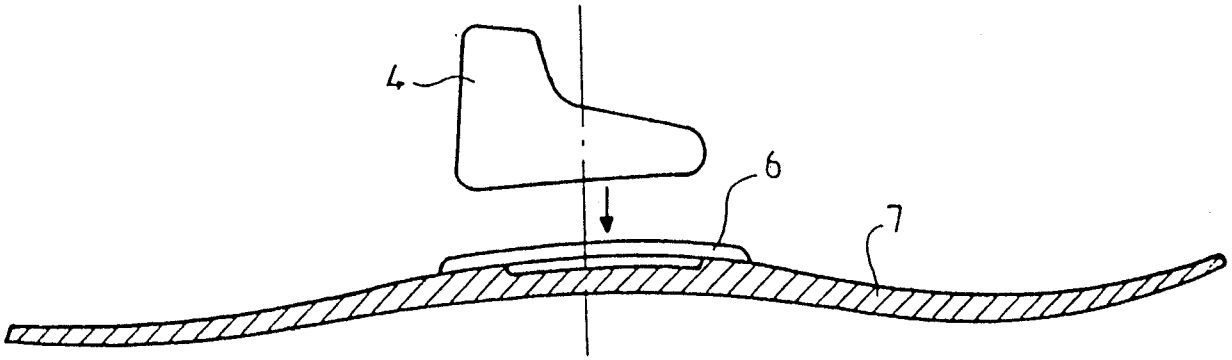
FIG. 14 is a longitudinal sectional view of the ski according to a preferred embodiment.
Figure 15:
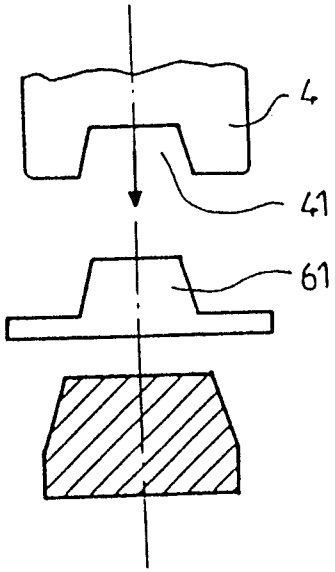
FIG. 15 is a transverse sectional view of the ski according to the embodiment of FIG. 14.

Finally, as is illustrated in FIGS. 14 and 15, it is possible to make a slit 5 by constructing a lower beam 7 and assembling all the mechanical reinforcement elements, that is, the core, the sole, the reinforcements, etc., and an upper beam 6 made of a molded plastic material covering the slit on a length at least equal to it.

This beam may advantageously be provided with a longitudinal rib 61 in which a complementary groove 41 cooperates, the latter being provided in the sole of boot 4.

The assembly of the upper beam 6 to lower beam 7 may be done by any means such as adhesion, vibration welding, etc.

As has been mentioned above, different means exist that oppose backward movement of the ski (scales, wax, seal skin) corresponding to different types of snow, and that are more or less long and complex to position under the ski.

Figure 16A:
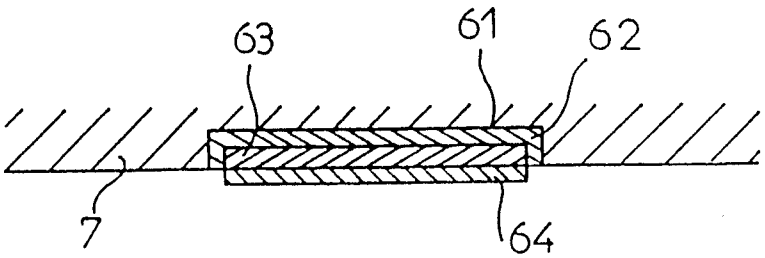
FIGS. 16*a* and 16*b* are a longitudinal sectional and bottom plan views showing an embodiment of the removable anti-backward movement element.
Figure 16B:
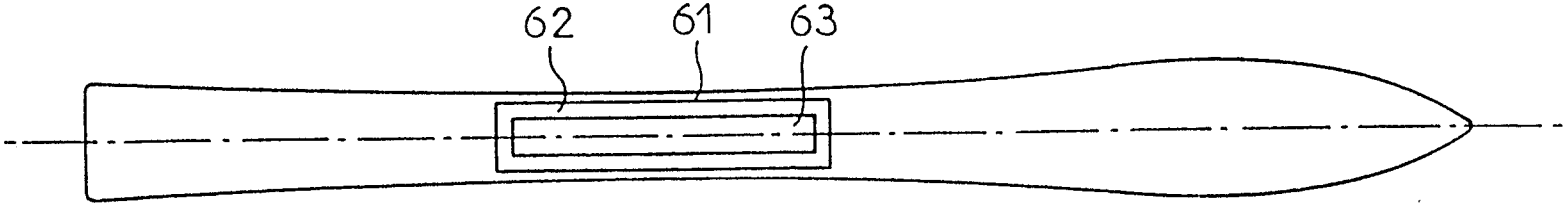

FIG. 16*a* and 16*b* illustrate an advantageous solution to resolve this problem: under the sole of the ski, at the level of waxing chamber 8, a removable plate 63 supporting the anti-backward movement system 64 may be positioned and removed quickly. The lower beam 7 comprises, at the level of waxing chamber 8, a recess 61 that may attain a width that is equal to the ski. This recess 61 acts as housing for a casing 62 fixed in recess 61 by any means such screwing, adhesion, welding. This casing may also be obtained directly during manufacture of the ski by molding or machining. A removable plate 63, advantageously made of a plastic material, is embedded in casing 62 and remains in place by a frician or snap bit. On this removable plate, an anti-backward movement system 64 is fixed, that one wishes to use under the ski. All that the skier need to do is have several removable plates 63, with, on each of them, one or several anti-backward movement systems so as to choose, at the last moment, the system that is best adapted to the circumstances. It is also possible that a removable plate 63 does not possess an anti-backward movement system on all or a part of its surface.

Figure 17C:
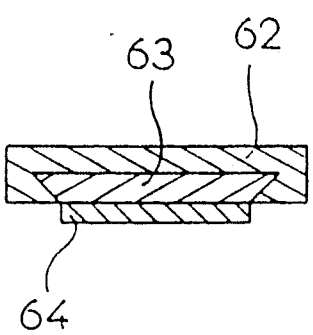
FIGS. 17*a*, 17*b*, and 17*c* are longitudinal and transverse sectional views, as well as an elevational view showing a second embodiment of the removable anti-backward movement element.
Figure 17A:
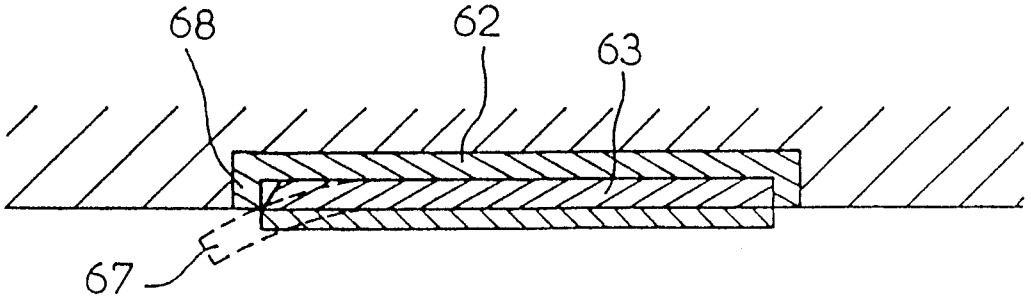
Figure 17B:
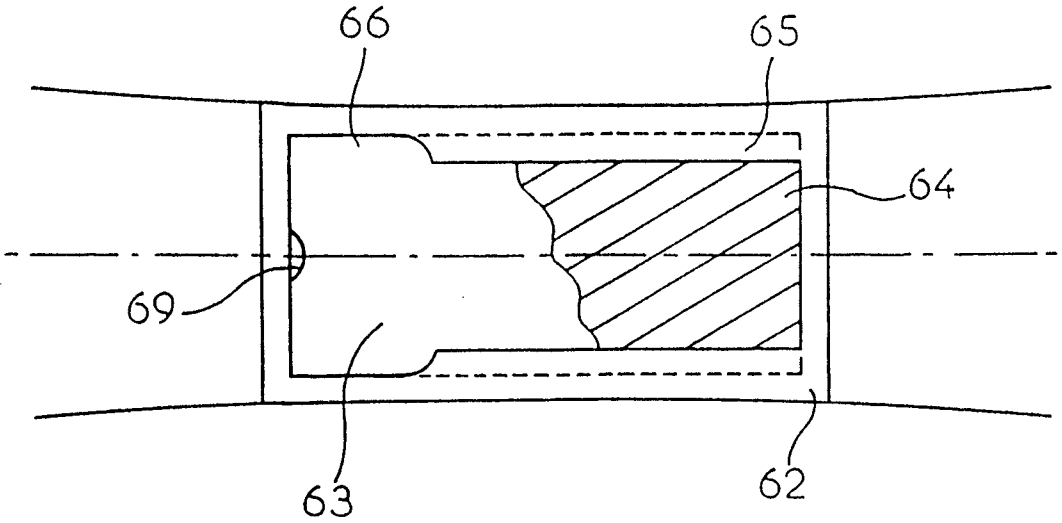

Another embodiment of casing 62 and of the removable plate 63 is represented in FIG. 17*a*, 17*b*, 17*c*. The casing 62, represented here on the entire width of the ski, comprises two grooves 65, their removable plate 63 sliding in these grooves 65. In order to enable the positioning of the removable plate 63 by sliding in casing 62, the groove 65 is eliminated in one end 66 so as to be able to deform in flexion the removable plate 63, as has been represented in dotted and dashed lines 67, such that the removable plate 63 may pass above edge 68 of casing 62, both during its positioning, and during the extraction of removable plate 63. A cut-out 69, provided in removable plate 63 (or an edge 68) facilitates the extraction manoeuver of this plate.

The instant application is based upon French patent application 90.10747, filed on Aug. 24, 1990, the disclosure of which is hereby expressly incorporated by reference in its entirety thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A cross-country ski for practicing alternating steps, including an impulse phase and a sliding phase, said cross-country ski comprising:

an integral body having a central portion, said central portion having an upward chamber at least in a rest position of the ski and being adapted to support a ski boot at a boot support zone, the boot support zone having a heel zone for application of pressure by the foot of a skier during the sliding phase and a metatarsal-phalanges zone for application of pressure by the foot of the skier during the impulse phase, thereby defining an impulse zone; and a slit formed within the central portion and having a predetermined longitudinal length of between 150–300 millimeters and extending transversely across the entire width of the ski, the slit being formed between an upper beam and a lower beam at least in the boot support zone, the upper and lower beams having opposed inner surfaces which are spaced apart by a substantially constant distance along the predetermined longitudinal length of the slit in the rest position of the ski, the slit extending forwardly beyond the impulse zone.

2. The cross-country ski of claim 1, wherein, along the length of the ski, the ski has an equilibrium point and wherein the slit extends forwardly to the equilibrium point, corresponding to a front part of the boot.

3. The cross-country ski of claim 1, wherein the length of the slit has a center and the impulse zone is located in front of the center of the slit.

4. The cross-country ski of claim 3, wherein the impulse zone is located at a point two-thirds of the length of the slit.

5. The cross-country ski of claim 1, wherein at least in an area of the ski at which the slit is located, the ski has a classic rectangular transverse section.

6. The cross-country ski of claim 1, wherein at least in an area of the ski at which the slit is located, the ski has a trapezoidal transverse section.

7. The cross-country ski of claim 6, wherein the trapezoidal transverse section comprises curvilinear side walls.

8. The cross-country ski of claim 6, wherein the trapezoidal transverse section comprises non-curvilinear side walls.

9. The cross-country ski of claim 1, wherein at least in an area of the ski at which the slit is located, the ski has an asymmetrical transverse section.

10. The cross-country ski of claim 1, wherein the slit is located in the area of the neutral fiber in the thickness of the ski.

11. The cross-country ski of claim 1, further comprising a longitudinally displaceable wedge located within the slit for providing the slit with an adjustable active length.

12. The cross-country ski of claim 1, further comprising a filling of an easily compressible elastic material within the slit.

13. The cross-country ski of claim 1, further comprising means for sealing the slit on opposite lateral sides of the ski.

14. The crosscountry ski of claim 1, wherein the slit is formed by having had material removed from a finished ski.

15. The cross-country ski of claim 1, made by the process comprising the steps of:

forming the slit by duplicately molding the upper beam and the lower beam separately on a thickness of a respective reinforcement element; and assembly the upper beam and the lower beam with adhesive, the reinforcement elements of the upper beam and the lower beam defining an upper wall and a lower wall of the slit.

16. The cross-country ski of claim 1, made by the process comprising the steps of:

covering a molded core with a pair of reinforcement elements;

duplicately molding the upper beam and the lower beam with the reinforcement elements covering the molded core; and removing the molded core to thereby define the slit.

17. The cross-country ski of claim 1, made by the process comprising the steps of:

assembling a plurality of reinforcement elements to thereby define the slit without an upper wall; and assembling the upper beam over the slit, the upper beam comprising a molded plastic material.

18. The cross-country ski of claim 17, wherein the upper beam is provided with a longitudinally extending rib for cooperation with a complementary longitudinally extending groove in the sole of the boot.

19. The cross-country ski of claim 1, wherein a waxing chamber exists beneath the boot support zone, the cross-country ski further comprising:

a sole;

a removable plate affixed to the sole; and an anti-backward movement system, provided substantially at the waxing chamber, borne by the removable plate.

20. The cross-country ski of claim 19, further comprising a casing located in the sole, wherein the removable plate is embedded within the casing.

21. The cross-country ski of claim 19, further comprising a casing located in the sole, the casing having at least a pair of grooves for retaining the removable plate within the casing.

22. The cross-country ski of claim 1, wherein the boot support zone has a length approximately equal to a length of a boot and wherein the slit has a length approximately equal to the length of the boot support zone.

23. The cross-country ski of claim 1, wherein the slit is defined by an open space extending through the ski there being no elastic material within the opening.

24. The cross-country ski of claim 1, wherein the slit has a length between 150 and 300 millimeters.

25. The cross-country ski of claim 1, wherein the slit has a length between 210 and 250 millimeters.

26. The cross-country ski of claim 1, wherein the slit has a thickness between about 2 and 4 millimeters.

27. The cross-country ski of claim 1, wherein, along the length of the ski, the ski has an equilibrium point and wherein the slit extends forwardly to the equilibrium point, corresponding to a front part of the boot.

28. A cross-country ski for practicing alternating steps, including an impulse phase and a sliding phase, said cross country-ski comprising:

a central portion, said central portion having an upward camber at least in a rest position of the ski and being adapted to support a ski boot at a boot support zone, the boot support zone having a heel zone for application of pressure by the foot of a skier during the sliding phase and a metatarsal-phalanges zone for application of pressure by the foot of the skier during the impulse phase, thereby defining an impulse zone; and a slit having a predetermined length and extending transversely across the entire width of the ski, the slit being formed between an upper beam and a lower beam at least in the boot support zone, the slit extending forwardly beyond the impulse zone, wherein the slit has longitudinally extending inner surfaces which are spaced apart by a substantially constant distance in the rest position of the ski and wherein the slit extends obliquely with respect to the upper and lower surfaces of the ski.

29. A cross-country ski for practicing alternating steps, including an impulse phase and a liding phase, said cross country-ski comprising:

a central portion, said central portion having an upward camber at least in a rest position of the ski and being adapted to support a ski boot at a boot support zone, the boot support zone having a heel zone for application of pressure by the foot of a skier during the sliding phase and a metatarsal-phalanges zone for application of pressure by the foot of the skier during the impulse phase, thereby defining an impulse zone; and a slit having a predetermined length and extending transversely across the entire width of the ski, the slit being formed between an upper beam and a lower beam at least in the boot support zone, the slit extending forwardly beyond the impulse zone, wherein the slit has a thickness that varies along the longitudinal length of the slit with minimum thickness at one end of the slit and maximum thickness at an opposite end of the slit.

30. A cross-country ski for practicing alternating steps, including an impulse phase and a sliding phase, said cross country-ski comprising:

a central portion, said central portion having an upward camber at least in a rest position of the ski and being adpated to support a ski boot at a boot support zone, the boot support zone having a heel zone for application of pressure by the foot of a skier during the sliding phase and a metatarsal-phalanges zone for application of pressure by the foot of the skier during the impulse phase, thereby defining an impulse zone;

said central portion having an upper portion and a lower portion, said lower portion having a pair of longitudinally extending, parallel lower sidewalls and said upper portion having a pair of longitudinally extending converging upper sidewalls; and a slit having a predetermined length and extending transversely across the entire width of the ski between the pair of upper sidewalls, the slit being formed between an upper beam and a lower beam at least in the boot support zone, the slit extending forwardly beyond the impulse zone.

31. A cross-country ski for practicing alternating steps, including an impulse phase and a sliding phase, said cross country-ski comprising:

a central portion, said central portion having an upward camber at least in a rest position of the ski and being adapted to support a ski boot at a boot support zone, the boot support zone having a heel zone for application of pressure by the foot of a skier during the sliding phase and a metatarsal-phalanges zone for application of pressure by the foot of the skier during the impulse phase, thereby defining an impulse zone; and a slit having a predetermined length and extending transversely across the entire width of the ski, the slit being formed between an upper beam and a lower beam at least in the boot support zone, the slit extending forwardly beyond the impulse zone, the lower beam comprising a core of the ski, a sole of the ski and reinforcement elements of the ski, the slit comprising an upwarding facing recess formed in the lower beam, the upper beam covering the recess in the lower beam.

* * * * *